US005286123A

United States Patent [19]

Kusumi

[11] Patent Number: 5,286,123

[45] Date of Patent: Feb. 15, 1994

[54] PAPER GUIDE MECHANISM FOR SERIAL PRINTER

[75] Inventor: Tatsuya Kusumi, Tokyo, Japan

[73] Assignee: NEC Corporation, Tokyo, Japan

[21] Appl. No.: 953,002

[22] Filed: Sep. 29, 1992

[30] Foreign Application Priority Data

Oct. 4, 1991 [JP] Japan ..... 3-257427

[51] Int. Cl.[5] ..... B41J 35/04; B41J 35/26

[52] U.S. Cl. ..... 400/247; 400/48; 400/248

[58] Field of Search ..... 400/247, 248, 248.1, 400/48, 642, 645

[56] References Cited

U.S. PATENT DOCUMENTS

| | | | |
|---|---|---|---|
| 1,679,845 | 8/1928 | Waldheim | 400/248 |
| 2,331,331 | 10/1943 | Lambert | 400/248 |
| 2,695,091 | 11/1954 | Ford et al. | 400/248 |
| 4,498,792 | 2/1985 | Falconieri | 400/248 |
| 5,071,272 | 12/1991 | Bell | 400/247 |

FOREIGN PATENT DOCUMENTS

| | | | |
|---|---|---|---|
| 0172574 | 9/1985 | Japan | 400/248 |
| 0244584 | 12/1985 | Japan | 400/248 |
| 0077775 | 4/1988 | Japan | 400/248 |

*Primary Examiner*—Edgar S. Burr
*Assistant Examiner*—Lynn D. Hendrickson
*Attorney, Agent, or Firm*—Foley & Lardner

[57] ABSTRACT

A paper guide mechanism for a serial printer wherein print paper can be prevented from being soiled by contact thereof with an ink ribbon or an ink ribbon guide plate while also leaping out of the ink ribbon through a printing hole of the ink ribbon guide plate is prevented. A paper guide plate is disposed in such a manner as to assure a gap from a print head so that the ink ribbon may not leap out readily from the printing hole of the ink ribbon guide plate mounted on the paper guide plate. The the paper guide plate is so shaped that, when the ink ribbon guide plate is mounted on the paper guide plate, the ink ribbon guide plate presents a concave configuration toward the platen so as to prevent contact between the ink ribbon guide plate and print paper as far as possible.

6 Claims, 2 Drawing Sheets

PAPER GUIDE MECHANISM FOR SERIAL PRINTER

BACKGROUND OF THE INVENTION

1. Field of the Invention

This invention relates to a paper guide mechanism for a serial printer including an ink ribbon guide plate and a paper guide plate by which print paper is kept from being soiled by an ink ribbon.

2. Description of the Related Art

Conventionally, a paper guide plate and an ink ribbon guide plate mounted on the paper guide plate are generally flat in sectional view. The ink ribbon guide plate is set in a gap between a platen and a print head. If the gap between the print head and the ink ribbon guide plate is made comparatively large, the ink ribbon guide plate is displaced toward the platen. Consequently, the entire faces of the ink ribbon guide plate and the paper guide plate are liable to come in contact with print paper on the platen. On the contrary, if one decreases the gap between the ink ribbon guide plate and the platen, then the gap between the print head and the ink ribbon guide plate is narrow so that the ink ribbon becomes liable to leap out from a printing hole which is formed in the ink ribbon guide plate thereby allowing the print head to contact therethrough with the print paper on the platen with the ink ribbon interposed therebetween.

Since the sectional shape of the conventional paper guide plate on which the ink ribbon guide plate is mounted is generally flat and, depending upon the position of the ink ribbon guide plate set in the gap between the platen and the print head, either the entire faces of the ink ribbon guide plate and the paper guide plate are brought into contact with the paper so that the print paper is soiled by the ink ribbon or the ink ribbon leaps out from the ink ribbon guide plate. As a result, the positioning operation to set the ink ribbon guide plate in position in the gap between the platen and the print head is quite difficult.

SUMMARY OF THE INVENTION

It is an object of the present invention to provide a paper guide mechanism for a serial printer wherein print paper is prevented from being soiled by contact with an ink ribbon or with an ink ribbon guide plate while preventing the leaping out or disengagement of the ink ribbon from the ink ribbon guide plate.

According to the present invention, there is provided a paper guide mechanism for a serial printer in which print paper is fed from a paper introducing mechanism to a paper discharging mechanism along a paper path extending along a print face of a platen and is printed by a print head with an ink ribbon interposed therebetween. The mechanism comprises a paper guide plate for guiding print paper along the paper path and pressing the print paper for feeding movement against the platen, and an ink ribbon guide plate mounted on the paper guide plate for supporting an ink ribbon for feeding movement thereon. The ink ribbon guide plate has a printing hole formed therein for allowing printing on the print paper by means of the print head therethrough. The paper guide plate is so shaped that, when the ink ribbon guide plate is mounted on the paper guide plate, the ink ribbon guide plate presents a convex configuration toward the platen in order to assure a gap between the print head and the ink ribbon guide plate so as to prevent the ink ribbon positioned between the ink ribbon guide plate and the print head from leaping out readily through the printing hole of the ink ribbon guide plate and to minimize contact between the ink ribbon guide plate and the print paper.

With the paper guide mechanism for a serial printer, since the paper guide plate is so shaped that, when the ink ribbon guide plate is mounted on the paper guide plate, the ink ribbon guide plate presents a convex configuration toward the platen in order to assure a gap between the print head and the ink ribbon guide plate so as to prevent the ink ribbon positioned between the ink ribbon guide plate and the print head from leaping out readily through the printing hole of the ink ribbon guide plate and to minimize contact between the ink ribbon guide plate and the print paper, the paper guide mechanism is advantageous in that print paper can be prevented from being soiled by contact thereof with the ink ribbon or the ink ribbon guide plate while also leaping out of the ink ribbon through the printing hole of the ink ribbon guide plate is prevented.

The above and other objects, features and advantages of the present invention will become apparent from the following description and the appended claims, taken in conjunction with the accompanying drawings.

BRIEF DESCRIPTION OF THE DRAWINGS

FIG. 1(*b*) is a right-hand side elevational view of the paper guide plate of FIG. 1(*a*);

FIG. 1(*c*) is a sectional view taken along line A—A of FIG. 1(*a*);

FIG. 2(*b*) is a side elevational view of the paper guide mechanism shown in FIG. 2(*a*).

DETAILED DESCRIPTION OF THE PREFERRED EMBODIMENT

Figure 1A:
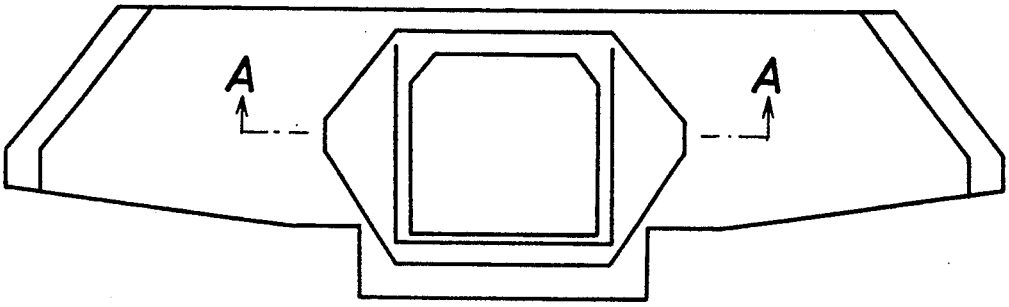
FIG. 1(*a*) is a front elevational view showing a paper guide plate to which the present invention is applied.
Figure 1B:
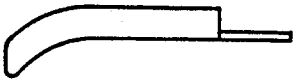
Figure 1C:
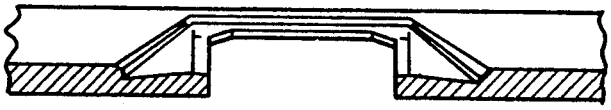
Figure 2A:
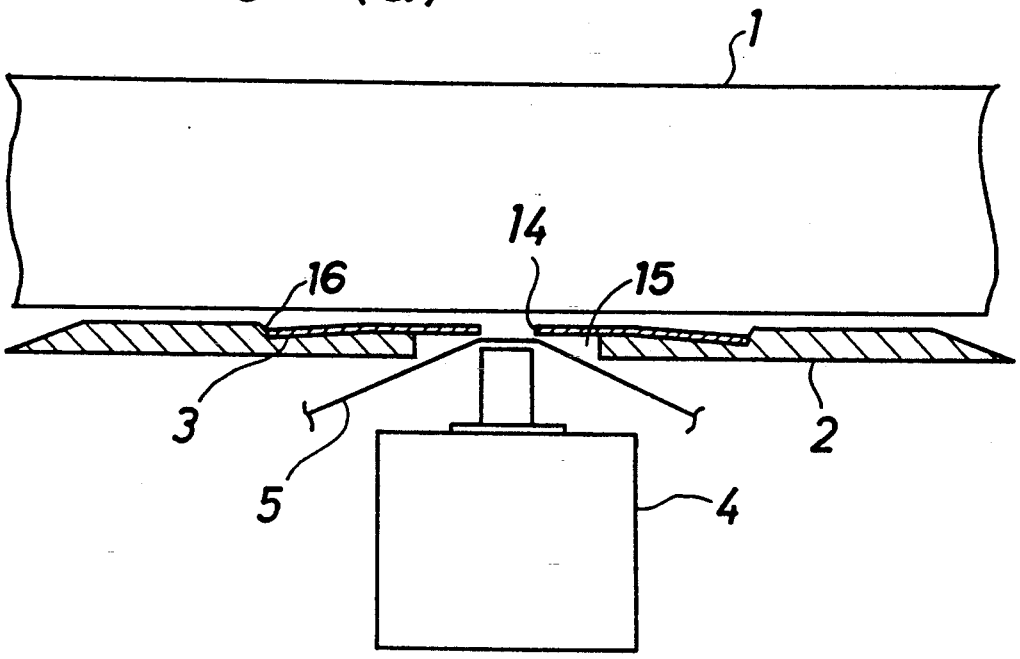
FIG. 2(*a*) is a sectional view of a paper guide mechanism for a serial printer taken along line B—B of FIG. 2(*b*) showing a preferred embodiment of the present invention.
Figure 2B:
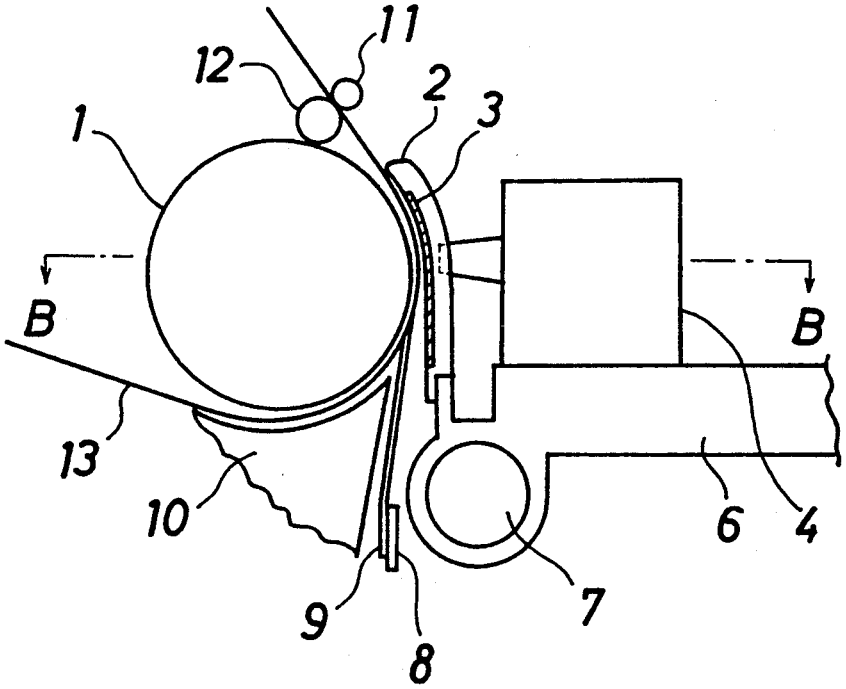

A paper guide plate to which the present invention is applied is shown in FIGS. 1(*a*) to 1(*c*), and a paper guide mechanism for a serial printer to which the paper guide plate shown in FIGS. 1(*a*) to 1(*c*) according to the present invention is shown in FIGS. 2(*a*) and 2(*b*).

Referring to FIGS. 2(*a*) and 2(*b*), a paper guide plate 2, a print head 4 and an ink ribbon 5 are carried at individual predetermined positions on a carrier 6 which is moved back and forth along a guide rod 7 mounted in parallel to a platen 1 which defines a print plane. An ink ribbon guide plate 3 is adhered to a face of the paper guide plate 2 in an opposing relationship to the platen 1. The ink ribbon 5 is fed along a fixed route in a fixed direction each time the carrier 6 makes a back and forth movement, and though not shown, a mechanism for feeding the ink ribbon 5 is carried on the carrier 6.

Print paper 13 is guided by a paper holding plate 9 mounted on a paper holding plate holder 8 and a paper guide portion 10, passes through a gap between the platen 1 and the paper guide plate 2 and ink ribbon guide plate 3 and is discharged, after being printed by the print heat 4 and the ink ribbon 5, by a discharging roller 12 and an auxiliary discharging roller 11.

The paper guide plate 2 is made greater in thickness at a central portion than a peripheral portion thereof on the face thereof on which the ink ribbon guide plate 3 is mounted such that, when the ink ribbon guide plate 3 is mounted on the paper guide plate 2, the ink ribbon guide plate 3 presents a convex configuration toward the platen 1 in order to assure a gap between the print head 4 and the ink ribbon guide plate 3 so as to prevent the ink ribbon 5 positioned between the ink ribbon guide plate 3 and the print head 4 from leaping out from a printing hole 14, which is formed in the ink ribbon guide plate 3 so as to allow the print head 4 to contact therethrough with the print paper 13 on the platen 1 with the ink ribbon 5 interposed therebetween. A recessed area 16 is formed on the front face of the paper guide plate 2 with the ink ribbon guide plate 3 secured to the recessed area 16 such that the front face of the ink ribbon guide plate 3 does not project from the front face of the paper guide plate 2 toward the platen 1, thereby minimizing contact between the ink ribbon guide plate 3 and the print paper 13. Also, a window 15 is formed in the paper guide plate 2 in order to assure a gap between the print head 4 and the ink ribbon guide plate 3, and the ink ribbon 5 is guided in the window 15 by the rear face of the ink ribbon guide plate 3.

Here, preferably the ink ribbon guide plate 3 projects at the central portion by 0.2 to 0.3 mm with respect to the peripheral portion thereof to assure a gap of 0.05 mm or more between the ink ribbon guide plate 3 and the print paper 13 in FIG. 2(*a*) and another gap of a magnitude greater by 0.5 mm or more than the thickness of the ink ribbon 5 between the ink ribbon guide plate 3 and the print head 4.

Having now fully described the invention, it will be apparent to one of ordinary skill in the art that many changes and modifications can be made thereto without departing from the spirit and scope of the invention as set forth herein.

What is claimed is:

1. A paper guide mechanism comprising:

a platen having a longitudinal axis including a print face;

paper feeding means for feeding print paper along a paper path, said paper path extending along said print face;

a print head;

an ink ribbon interposed between said print head and said platen;

a paper guide plate for guiding said print paper along said paper path and pressing said print paper against said platen for feeding movement against said platen; and an ink ribbon guide plate mounted on said paper guide plate and having a printing hole through which said printing head prints on said print paper, said ink ribbon guide plate having a convex configuration toward said platen in the direction of said longitudinal axis;

wherein said ink ribbon is prevented from leaping out through said printing hole as said ink ribbon enters and exits said printing hole during printing operation.

2. The apparatus according to claim 1 wherein:

one end of said ink ribbon guide plate is attached at a recessed portion of said paper guide plate such that contact between said ink ribbon guide plate and said print paper on said platen is minimized.

3. The apparatus according to claim 1 wherein:

said paper guide plate includes a recessed area on a side facing said platen;

wherein an end of said ink ribbon guide plate is mounted on said recessed area of said paper guide plate such that said ink ribbon guide plate is at a greater distance from said print face of said platen at a peripheral portion of said ink ribbon guide plate than at a central portion of said ink ribbon guide plate, thereby forming said convex configuration, and such that contact between said print paper on said platen and said ink ribbon guide plate is minimized.

4. The apparatus according to claim 1 wherein:

said paper guide plate has a thickness at a central portion which is greater than a peripheral portion thereof on the face thereof on which said ink ribbon guide plate is mounted on said paper guide plate such that said ink ribbon guide plate presents said convex configuration toward said platen and such that a recessed area is formed on the front face of said paper guide plate with said ink ribbon guide plate mounted thereon;

whereby said front face of said ink ribbon guide plate does not project from said front face of said paper guide plate toward said platen such that contact between said print paper on said platen and said ink ribbon guide plate is minimized.

5. The apparatus according to claim 1 wherein:

said paper guide plate includes a first portion in which the face of said paper guide plate facing said platen tapers away from said platen and said paper guide plate having a second portion in which the face of said paper guide plate facing said platen tapers toward said platen and said paper guide plate having a recessed area formed in said face of said paper guide plate facing said platen in an area where said first and second portions of said paper guide plate meet; and said ink ribbon guide plate mounted on said paper guide plate and supporting and feeding said ink ribbon, one end of said ink ribbon guide plate being attached at said recessed area of said paper guide plate thereby reducing contact between said ink ribbon guide plate and said print paper on said platen.

6. A method for guiding an ink ribbon in a printer, comprising the steps of:

providing a platen having a longitudinal axis;

guiding print paper along a paper path extending along a print face of said platen by means of a paper guide plate;

feeding an ink ribbon with an ink ribbon guide plate mounted on said paper guide plate with a printing hole formed therein;

supporting said ink ribbon with said ink ribbon guide plate;

preventing said ink ribbon from leaping out of said printing hole by forming a convex configuration of said ink ribbon guide plate with respect to said platen in the direction of said longitudinal axis; and minimizing contacting between said print paper on said platen and said ink ribbon guide plate by means of said ink ribbon guide plate mounted in a recessed area of said paper guide plate.

* * * * *